US006118211A

United States Patent [19]

Tiers

[11] Patent Number: 6,118,211

[45] Date of Patent: Sep. 12, 2000

[54] DEVICE FOR SUSPENDING THE SHADOW MASK OF A CATHODE RAY DISPLAY TUBE COMPRISING A BIMETAL, AND BIMETAL

[75] Inventor: Jean-François Tiers, Sauvigny lès Bois, France

[73] Assignee: Imphy S.A., Puteaux, France

[21] Appl. No.: 09/001,652

[22] Filed: Dec. 31, 1997

[30] Foreign Application Priority Data

Dec. 31, 1996 [FR] France ..... 96 16253

[51] Int. Cl.[7] ..... H01J 29/80

[52] U.S. Cl. ..... 313/402; 313/404; 313/405; 313/407; 313/408

[58] Field of Search ..... 313/402, 404, 313/405, 407, 408, 461, 477 R, 482; 428/619

[56] References Cited

U.S. PATENT DOCUMENTS

| | | | |
|---|---|---|---|
| 3,781,583 | 12/1973 | Ornstein | 313/405 |
| 4,131,720 | 12/1978 | Spengler | 428/619 |
| 4,638,211 | 1/1987 | Fonda | 313/405 |
| 4,678,963 | 7/1987 | Fonda | 313/405 |
| 4,792,719 | 12/1988 | Ornstein . | |
| 5,502,350 | 3/1996 | Uehara et al. . | |
| 5,643,697 | 7/1997 | Baudry et al. . | |

FOREIGN PATENT DOCUMENTS

| | | |
|---|---|---|
| 0 143 707 | 6/1985 | European Pat. Off. . |
| 2 346 812 | 10/1977 | France . |

OTHER PUBLICATIONS

Patent Abstracts of Japan, vol. 066, No. 205 (E–136), Oct. 16, 1985 & JP 57–111933 A (Tokyo Shibaura Denki KK), Jul. 12, 1983.

*Primary Examiner*—Nimeshkumar D. Patel
*Assistant Examiner*—Mack Haynes
*Attorney, Agent, or Firm*—Oblon, Spivak, McClelland, Maier & Neustadt, P.C.

[57] ABSTRACT

Device (8) for suspending the shadow mask (1) of a cathode ray display tube, of the type comprising a thermostatic bimetal (10) whose deflection between 60° C. and 130° C. is less than the deflection between 20° C. and 60° C. Bimetal whose deflection between 60° C. and 130° C. is less than its deflection between 20° C. and 60° C.

6 Claims, 1 Drawing Sheet

DEVICE FOR SUSPENDING THE SHADOW MASK OF A CATHODE RAY DISPLAY TUBE COMPRISING A BIMETAL, AND BIMETAL

BACKGROUND OF THE INVENTION

1. Field of the Invention

The invention relates to a device for suspending the shadow mask of a cathode ray display tube.

2. Discussion of the Background

Between the display screen provided with luminophores and the electron gun, a color cathode ray display tube comprises a shadow mask consisting of a metal sheet pierced with a multitude of holes. This shadow mask is intended to ensure proper separation of the three electron beams which the electron gun emits, so that each electron beam reaches only the luminophore corresponding to the color associated with it. It is necessary to align the electron beams, the luminophores and the holes in the shadow mask properly in order to obtain a high-quality image.

When the tube is in operation, the shadow mask heats up (its temperature may reach 130° C.), it expands and, in the absence of particular arrangements, this expansion gives rise to misalignment of the electron beams, the luminophores and the holes in the shadow mask. This results in a loss of image quality.

In order to compensate for this unfortunate expansion, the shadow mask is suspended from the glass slab constituting the screen by thermostatic bimetals which generally consist of an austenitic stainless steel and an Fe—Ni alloy whose chemical composition comprises, by weight, from 36% to 42% of nickel. These bimetals, which may be of the "edge welded" type or of the "plated" type, have a linear behavior, that is to say a linear variation of deflection with temperature, at least up to temperatures of the order of 200° C. The bimetals heat up at the same time as the shadow mask and deform in such a way that the distance from the shadow mask to the display screen changes as a function of the temperature of the shadow mask. This results in compensation for the effects generated by the heating of the shadow mask. However, the temperature of the tube itself may increase significantly under the effect of room temperature and reach, for example, 50° C. Under these conditions, the compensation of the heating effect of the shadow mask is no longer sufficient and overcompensation takes place.

SUMMARY OF THE INVENTION

The object of the present invention is to overcome this drawback by providing a means for limiting or avoiding the phenomenon of overcompensation.

To this end, the invention relates to a device for suspending the shadow mask of a cathode ray display tube, the device comprising a thermostatic bimetal whose deflection between 60° C. and 130° C. is less than its deflection between 20° C. and 60° C.

The deflection of the bimetal between 60° C. and 130° C. is preferably less than 0.8 times, or better still 0.65 times, the deflection of the bimetal between 20° C. and 60° C.

The bimetal, which also forms part of the invention and whose deflection between 60° C. and 130° C. is less than its deflection between 20° C. and 60° C., may be of the edge welded type or of the plated type. It preferably consists of at least one austenitic stainless steel and an Fe—Ni alloy whose chemical composition comprises, by weight, from 27% to 32% of nickel, such as 27.5, 28, 28.5, 29, 29.2, 29.3, 29.4, 29.5, 29.6, 29.7, 29.8 and 29.9%, <30%, 30%, 31% and 31.5%.

DESCRIPTION OF THE DRAWINGS

The invention will now be described in more detail with reference to the appended figures.

Figure 1:
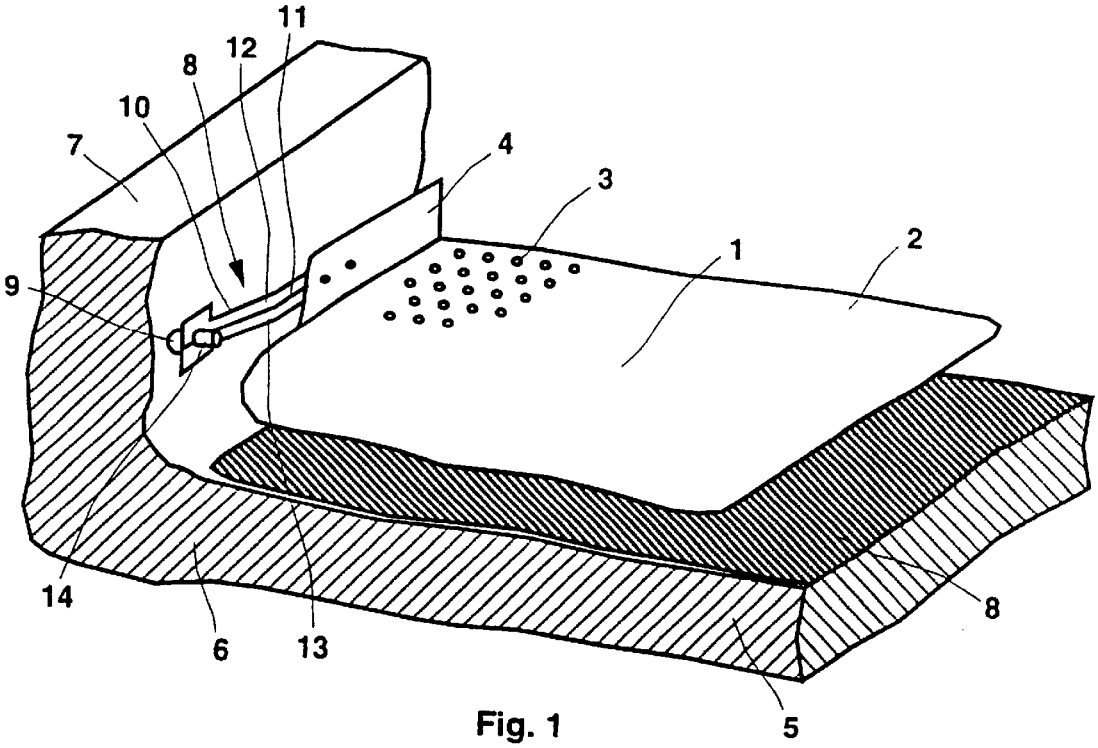
FIG. 1 represents a device for suspending the shadow mask of a cathode ray display tube, comprising an edge welded bimetal (the screen of the cathode ray tube and the shadow mask are only partially represented).
Figure 2:
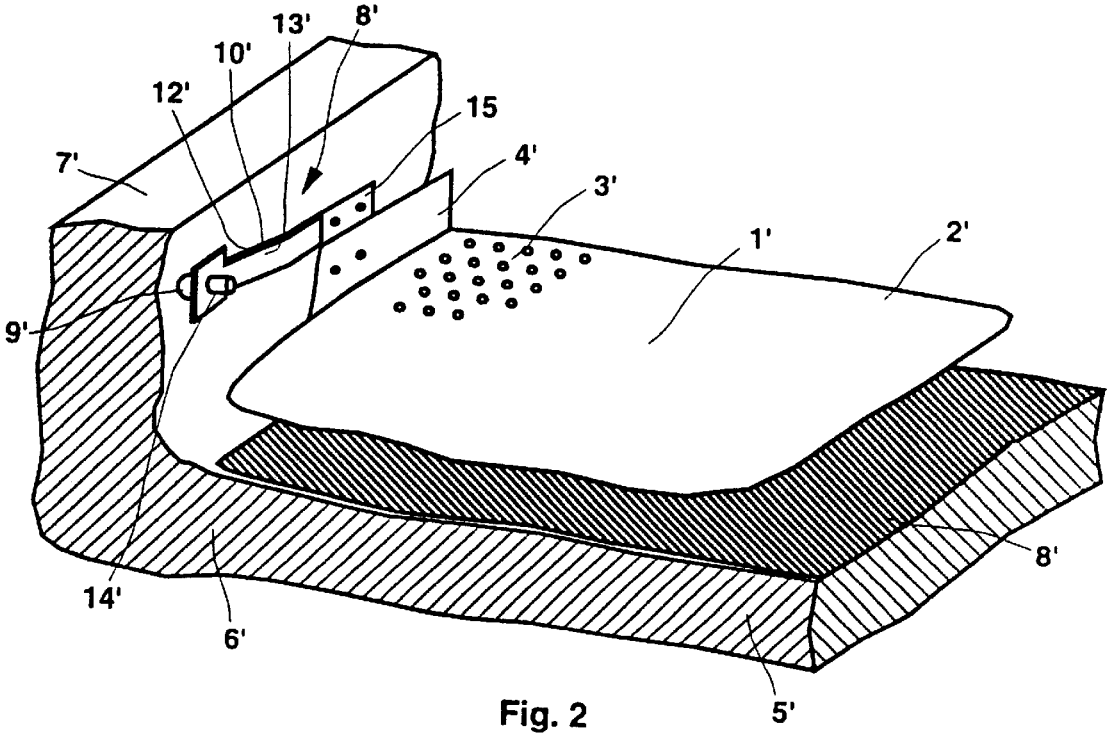
FIG. 2 represents a device for suspending the shadow mask of a cathode ray display tube, comprising a plated bimetal (the screen of the cathode ray tube and the shadow mask are only partially represented).

In both FIG. 1 and FIG. 2, the shadow mask 1, 1', essentially consisting of a metal sheet 2, 2' pierced with a multitude of holes 3, 3' and mounted on a rigid frame 4, 4' arranged at its periphery, is arranged facing the display screen 5, 5' consisting of a glass slab 6, 6' having peripheral lips 7, 7' and, facing the shadow mask 1, 1', including a layer 8, 8' of luminophores.

In FIG. 1, the shadow mask 1 is suspended from the glass slab 6 by a suspension means 8 consisting of an anchoring pin 9 and of a bimetal 10 of the "edge welded" type, that is to say split across the junction line 11 of two metal strips 12 and 13 of different types. The anchoring pin 9 is sealed in the lip 7 of the glass slab 6. At one of its ends, the bimetal 10 includes a hole 14 into which the anchoring pin 9 is inserted; at the other end, it is fixed to the rigid frame 4 by welding.

In FIG. 2, the shadow mask 1' is suspended from the glass slab 6' by a suspension means 8' consisting of an anchoring pin 9', of a bimetal 10' of the plated type, that is to say split into two metal strips 12' and 13' of different types which are pressed against one another, for example by colamination, and of a spring 15. The anchoring pin 9' is sealed in the lip 7' of the glass slab 6'. At one of its ends, the bimetal 10' includes a hole 14' into which the anchoring pin 9 is inserted; at the other end, it is fixed to the rigid frame 4 via the spring 15 by welding.

In order to obtain sufficient compensation both when the display tube (in particular the lip 7 or 7' of the glass slab 6 or 6') is at normal temperature, that is to say about 20° C., and when it is heated, for example to about 50° C., the bimetal 10 or 10' has a deflection between 60° C. and 130° C. which is less than the deflection that it has between 20° C. and 60° C.; the deflection of the bimetal between two temperatures being, for a bimetal having one free end and one fixed end, the displacement of the free end generated by the entire bimetal changing from one temperature to the other. The deflection between 60° C. and 130° C. is preferably less than 0.8 times, or better still 0.65 times, the deflection between 20° C. and 60° C. The reason for this is that, when the shadow mask heats up, it expands and the distance between the holes which it contains increases. In order to compensate for the effect of this expansion, the shadow mask needs to be brought closer to the screen, this being what is done by bimetals whose mean temperature balances out between the temperature of the lip of the glass slab and the temperature of the shadow mask. Nevertheless, the optimum setting of the position of the shadow mask with respect to the screen depends only on the temperature of the shadow mask. However, for equal shadow mask temperature, the mean temperature of the bimetal increases with the temperature of the lip of the glass slab, with the result that the deflection of the bimetal generated by the heating of the shadow mask is accentuated by the possible heating of the lip of the glass slab. This extra deflection is a parasitic effect which should be minimized, and the inventors have observed that the extent of this effect decreases if the bimetal is insensitive to temperature variations at the top of its operating temperature range.

Both in the case of FIG. 1 and in the case of FIG. 2, the two materials which constitute the strips 12 and 12', on the one hand, 13 and 13', on the other hand, of the bimetals 10 and 10' are, for the one part, an austenitic stainless steel, for example of type 304 (according to the ASTM standard), and for the other part an Fe—Ni alloy whose chemical composition comprises, by weight, from 27% to 32% of nickel. The Fe—Ni alloy is specifically chosen to provide a deflection between 60° C. and 130° C. which is less than the deflection between 20° C. and 60° C. The provision of a bimetal meeting the invention criteria is within the skill of the ordinary artisan, and is contrary to the present state of the art in which alloys are designed to provide linear behavior.

More precisely, the Fe—Ni alloy may be an alloy whose chemical composition comprises, by weight, about 30.9% of nickel, about 1.2% of manganese, about 0.15% of silicon, about 0.15% of carbon, the remainder being iron and impurities resulting from the production. In this case, the deflection between 60° C. and 130° C. is about 0.76 times the deflection between 20° C. and 60° C.

The Fe—Ni alloy may also be an alloy whose chemical composition comprises, by weight, about 29.3% of nickel, about 1.2% of manganese, about 0.15% of silicon, about 0.15% of carbon, the remainder being iron and impurities resulting from production. In this case, the deflection between 60° C. and 130° C. is about 0.61 times the deflection between 20° C. and 60° C., which is more favorable than the previous case for limiting overcompensation.

The choice of the two materials of which the two layers of the bimetal are formed is not limited to the examples which have been mentioned. Indeed, the person skilled in the art will be able to choose these materials after having determined, for example by expansion measurement tests, the change in their coefficient of expansion in the operating temperature range which is envisaged, then by using computation to simulate the behavior of a bimetal consisting of these two materials.

Similarly, the two operating ranges (20° C./60° C. and 60° C./130° C.) may be adapted from case to case according to particular characteristics of the cathode ray display tube on which they are mounted.

It may be noted that, on occasion, bimetals have an extra layer, for example of copper, in addition to the two layers which have just been described, the purpose of this extra layer being to improve the lengthwise thermal conductivity of the bimetal.

In the present invention the bimetal preferably has non-linear expansion comportment below 130° C., preferably with the deflection between 60° C. and 130° C. being less than that observed between 20° C. and 60° C., these ranges being non-overlapping.

This application is based on French patent application 96 16 253 filed Dec. 31, 1996, incorporated herein by reference.

What is claimed as new and is desired to be secured by Letters Patent of the United States is:

1. A device for suspending a shadow mask of a cathode display tube, comprising:

a thermostatic bimetal consisting of at least one austenitic stainless steel and an Fe—Ni alloy, the chemical composition of the alloy comprising by weight of less than 30% of Ni, wherein the deflection of the bimetal ranging from 60° C. to 130° C. is less than the deflection of the bimetal ranging from 20° C. to 60° C.

2. The device for suspending a shadow mask as claimed in claim 1, wherein the deflection of the bimetal between 60° C. and 130° C. is less than 0.8 times the deflection of the bimetal between 20° C. and 60° C.

3. The device for suspending a shadow mask as claimed in claim 1, wherein the deflection of the bimetal between 60° C. and 130° C. is less than 0.65 times the deflection of the bimetal between 20° C. and 60° C.

4. The device for suspending a shadow mask as claimed in claim 1, wherein the bimetal is an edge welded bimetal.

5. The device for suspending a shadow mask as claimed in claim 1, wherein the bimetal is a plated bimetal.

6. A bimetal which consists of at least one austenitic steel and an Fe—Ni alloy comprising less than 30% by wt Ni whose deflection ranging from 60° C. to 130° C. is less than its deflection ranging from 20° C. to 60° C.

* * * * *